United States Patent [19]

Glover et al.

[11] Patent Number: 4,898,539

[45] Date of Patent: Feb. 6, 1990

[54] SURFACE MOUNT HDI CONTACT

[75] Inventors: Douglas W. Glover, Harrisburg; Donald R. Harner, Camp Hill, both of Pa.

[73] Assignee: AMP Incorporated, Harrisburg, Pa.

[21] Appl. No.: 314,331

[22] Filed: Feb. 22, 1989

[51] Int. Cl.[4] ..... H01R 9/09; H01R 13/24

[52] U.S. Cl. ..... 439/81; 439/78; 439/733; 439/862

[58] Field of Search ..... 439/65, 66, 76, 78, 439/81, 82, 733, 862, 741, 869, 870

[56] References Cited

U.S. PATENT DOCUMENTS 3,348,191 10/1967 Kinkaid ..... 439/741 X
4,354,729 10/1982 Grabbe et al. ..... 339/258 R
4,699,593 10/1987 Grabbe et al. ..... 439/71

*Primary Examiner*—Steven C. Bishop
*Attorney, Agent, or Firm*—James M. Trygg

[57] ABSTRACT

An electrical pin header connector (2) comprises an insulating housing (4) having an interface surface (6) and an opposite mating face (8), between which extends a grid array of electrical contact element receiving cavities (10). In each cavity (10) is an electrical contact element (12) having an elongate contact spring (14) with a contact nose (16) projecting from the interface surface (6) for engagement by a respective contact pad (44) of a grid array of contact pads (44) on an interface surface (42) of a mother printed circuit board (40). Each contact element (12) has a contact pin (26) projecting from the mating face (8) of the housing (4). The contact springs (14) are angled by 45° with respect to X and Y axes of the grid array of cavities (10), for maximum contact density. The contact pin (26) of each contact element (12) has been twisted through 45° with respect to the contact spring (14) thereof so that opposed flat contact surfaces (C) of the contact pin (26) are parallel to one axis of the grid array of cavities (10) and are at right angles to the other. This orientation of the contact surfaces (C) enables the pin header connector (2) to be mated with a mating connector (32) having twin contact beam terminals (54) so that each contact surface (60) of each pair of twin beams (58) engages a respective contact surface (C) of a respective contact pin (26).

14 Claims, 4 Drawing Sheets

SURFACE MOUNT HDI CONTACT

This invention relates to a pin header electrical connector for use in making electrical connections to contact pads arranged in a grid array on an interface surface of a circuit board, for example, and also relates to an electrical contact element for such a connector. The invention specially concerns such a connector, the contact elements of which are provided with contact pins each having opposed flat contact surfaces for engagement by respective contact beams of a twin beam receptacle terminal of a mating electrical connector.

BACKGROUND OF THE INVENTION

There is described in U.S. Pat. No. 4,354,729, an electrical connector comprising an insulating housing in the form of a rectangular annulus, in cavities extending around the periphery of which, are electrical contact elements each comprising a contact arm having a contact pad on an interface surface of an electronic component. The contact arm of each contact element is connected by way of a support arm, to a rectangular cross section electrical pin for soldering into a plated through hole in a printed card, thereby connecting a respective contact pad on the interface surface to a conductor of the card. The pin, and the remainder of the contact element, are uniplanar, each contact element, and consequently opposed flat surfaces of its contact pin extending parallel to one of the X and Y axes of the housing. Such a connector is usuitable for use where the pads on said interface surface are arranged in a high density grid array comprising, for example, four rows of six contact pads each. Further, once secured to the circuit board, the contact elements can only be removed therefrom after disconnecting the soldered joints between the contact pins and the plating of the holes in the circuit board.

SUMMARY OF THE INVENTION

The present invention provides an electrical connector having contact elements, arranged with maximum density in a housing, for engagement with contact pads disposed in a grid array on an interface surface. The connector being matable with a mating electrical connector, has twin beam receptacle terminals for engaging opposed flat contact surfaces of rectangular cross section contact pins projecting from the contact elements. A problem arises because the contact elements need to have relatively long contact springs which are provided with contact noses for engaging the pads and at the same time the contact noses must conform precisely to the grid array. Each opposed flat contact surface of each contact pin must extend parallel to the X or Y axis of the grid array if the pin is to properly mate with a twin beam receptacle terminal of the mating connector, given that the contact surfaces of each contact beam customarily extend parallel to one of said X and Y axes. Thus, if the contact elements were to be uniplanar, then the contact springs thereof would all have to extend parallel to one of the said X and Y axes with a result that the contact elements could not be arranged with maximum density, with their noses in exact conformity with the grid array of the contact pads on said interface surface.

The contact springs are, therefore, orientated at an angle, for example an angle of 45°, with respect to the X and Y axes of the grid array of the contact noses, while the contact pins are oriented with their contact surfaces parallel with one of those axes.

Each contact element may be stamped from a single piece of sheet metal stock, for example brass stock. The contact pin of the contact element is subsequently twisted, for example through 45°, with respect to the remainder of the contact element before assembling the contact element to its housing. The interface surface may be that of a mother circuit board, for a personal computer, for example, the mating connector carrying a row of daughter circuit boards having conductors connected to the terminals of the mating connector.

An electrical contact element according to the invention comprises a uniplanar contact spring, a retention portion having means for retaining it in a cavity in an insulating housing, and a rectangular cross section contact pin. The pin and the retention portion have a common longitudinal axis, the contact spring comprising a spring arm connected to the retention portion by means of a support arm extending at right angles to the contact pin and having a contact nose projecting away from the contact pin in line with the common longitudinal axis. The contact pin has opposite flat contact surfaces which are angularly displaced from the plane of the contact spring about the common longitudinal axis, for example by an angle of about 45°.

Each pin will usually be of square cross section.

DETAILED DESCRIPTION OF THE INVENTION

Figure 1:
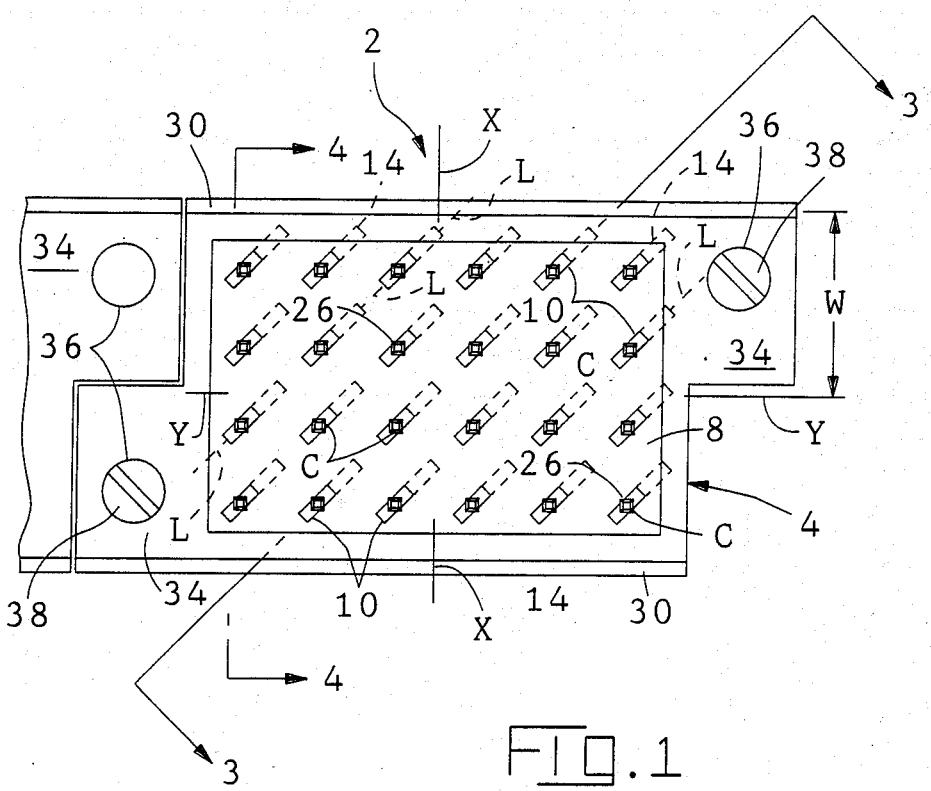
FIG. 1 is a top plan view of a pin header first electrical connector showing a fragment of a second identical electrical connector in modular relationship therewith.
Figure 2:
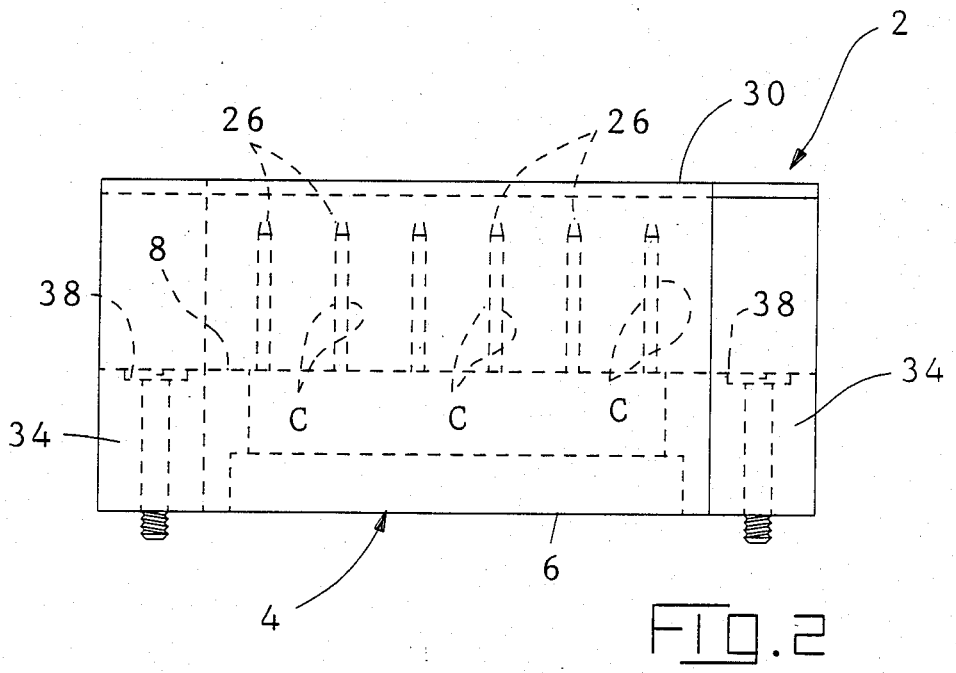
FIG. 2 is a side view of said first connector.
Figure 3:
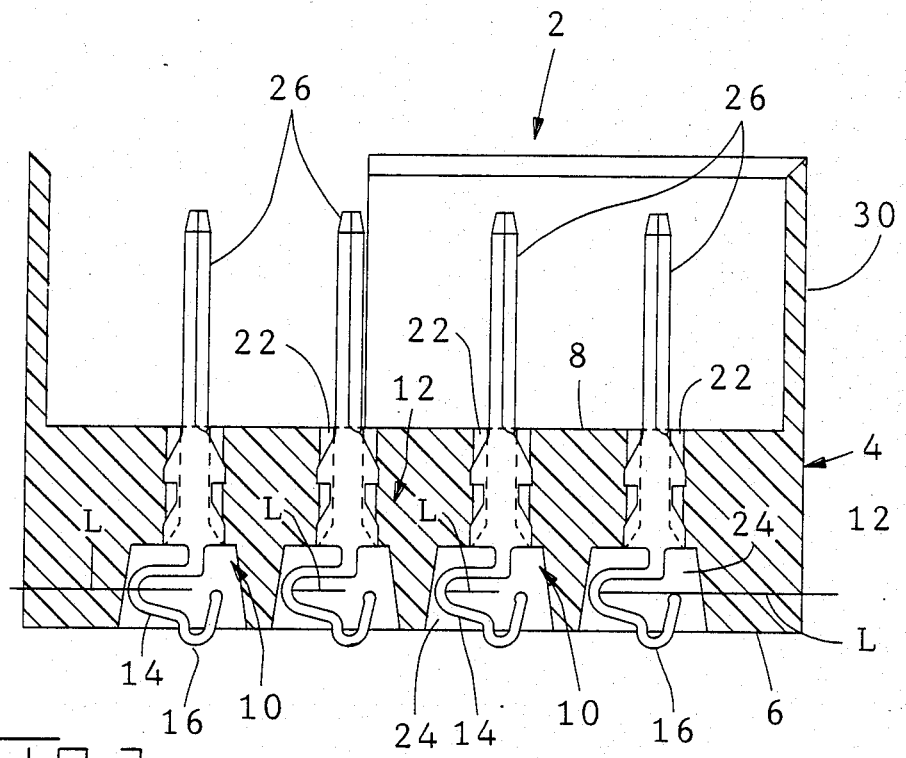
FIG. 3 is a cross-sectional view taken on the lines 3—3 of FIG. 1.
Figure 4:
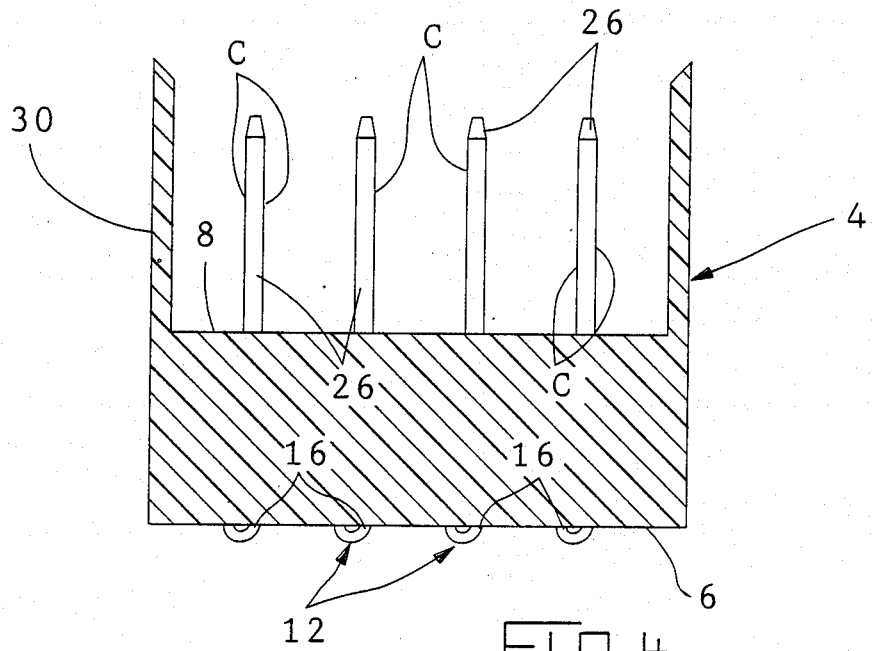
FIG. 4 is a cross-sectional view taken on the lines 4—4 of FIG. 1.
Figure 5:
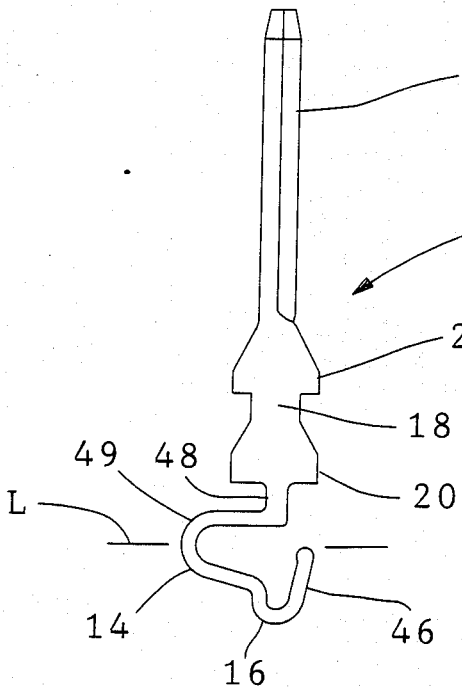
FIG. 5 is a side view of an electrical contact element of said pin header connectors.

As shown in FIGS. 1 to 5, a pin header electrical connector 2 comprises an insulating housing 4 having a flat interface surface 6 and a mating face 8 opposite thereto. The housing 4 includes a multiplicity of contact element receiving, slot shaped, through cavities 10 disposed in a rectangular grid array. Each cavity 10 opens into both the interface surface 6 and the mating face 8. A multiplicity of one-piece electrical contact elements 12 are each retained in a respective one of the cavities 10. Each cavity 10 comprises a wider portion 24 opening into the surface 6 and a narrower portion 22 opening into the face 8 and communicating with the cavity portion 24. Each contact element 12 is stamped and formed from sheet metal stock, for example of 0.025 inches (0.635 mm) in thickness, and comprises an elongate contact spring 14 in the cavity portion 24, proximate to the interface surface 6 and having a longitudinal axis L extending parallel to that surface or substantially so. A contact nose 16 is disposed on the contact spring 14 projecting from the interface surface 6. A retention part 18 force fitted into the cavity portion 22 is provided with two pairs of retention barbs 20 spaced from one another longitudinally of the part 18 and biting into the opposite walls of said cavity portion 22. A rectangular cross section, rectilinear contact pin 26 projects from the part 18 outwardly of the mating face 8. The contact spring 14 and the retention part 18 of each contact element 12 are coplanar. The contact element 12 is stamped from the said sheet metal stock, with the contact pin 26 coplanar with the retention part 18 and the contact spring 14. The pin 26 is then twisted about its longitudinal axis, relative to the spring 14 and the part 18, through an angle of 45°. Thus, each contact element 12, presents opposed, flat contact surfaces C angled by 45° with respect to the rest of the contact element, as best seen in FIG. 4. The longitudinal axis of the pin 26 substantially bisects the contact nose 16. As shown in FIG. 1, said rectangular grid array has X and Y axes extending normally of each other in the plane of the surface 6. In the interest of maximum contact density, the longitudinal axes L of the contact springs 14, and the parts 18 of the contact elements 12, extend at an angle of 45° with respect to each of the X and Y axes. By virtue, however, of the twisting operation described above, the opposed contact surfaces C of each contact pin 26, lie parallel to the X axis and at right angles to the Y axis, of the grid array.

Figure 6:
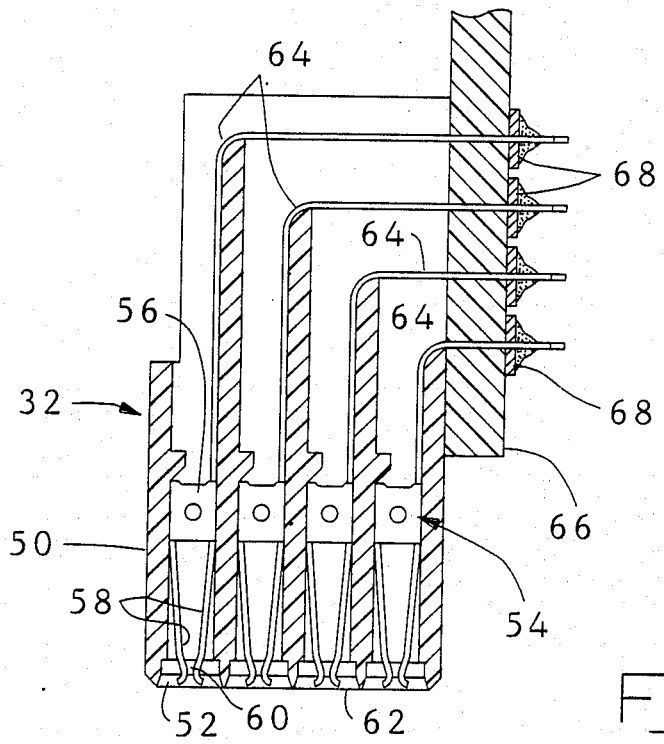
FIG. 6 is an end view of an electrical socket connector for mating with said pin header first connector.
Figure 7:
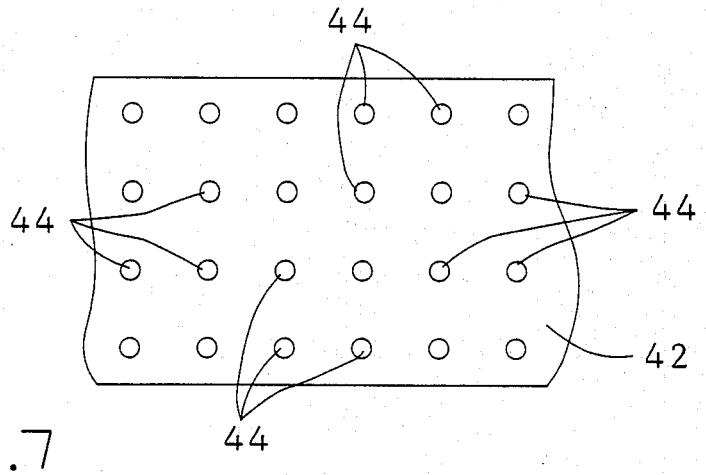
FIG. 7 is a diagrammatic top plan view of a mother circuit board.
Figure 8:
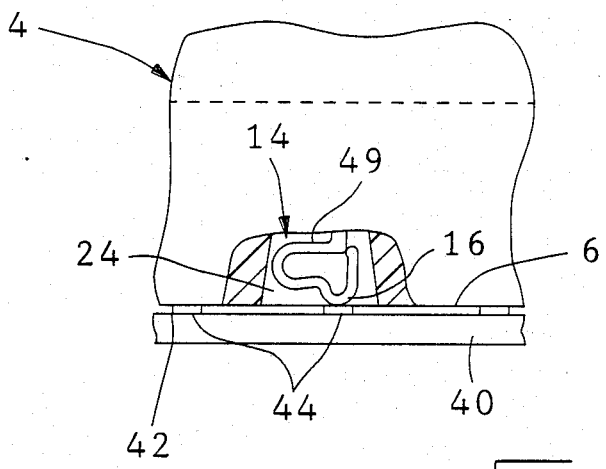
FIG. 8 is a fragmentary side view, shown partly in cross section, illustrating the pin header connector assembled to the circuit board.

There extend perpendicularly from the mating face 8, shroud walls 30 which serve to protect the contact pins 26 and to receive between them a mating electrical socket connector 32 shown in FIG. 6. Then the housing 4 is provided at each end thereof with a mounting lug 34, the lug 34 at one end of the housing 4, being offset from the lug 34 at the other end of the housing 4 by a distance equal to the width W of a lug 34. Each lug 34 has an opening 36 for receiving a fastener 38 for securing the connector 2 to a mother printed circuit board 40 (FIGS. 7 and 8) with the interface surface 6 of the housing 4 facing an interface surface 42 of the board 40. The board 42 has thereon a rectangular grid array of contact pads 44 of the same number and arrangement as the contact noses 16 projecting from the interface surface 6 of the connector 2. When the connector 2 has been secured to the board 40, each nose 16 resiliently engages a respective one of the pads 44 (FIG. 8), a contact arm 46 on each nose 16 being thereby forced against a stub 48 connecting a support arm 49 of the contact spring 14 of the element 12 to the retention part 18; thereby providing a shortened electrical path between the nose 16 and the pin 26.

The mating connector 32 will now be described with reference to FIG. 6. The connector 32 comprises an insulating housing 50 having therein a rectangular grid array of terminal receiving cavities 52 of the same number and arrangement as the cavities 10 of the housing 4 and the pads 44 of the board 40. Each cavity 52 contains an electrical terminal 54, see FIG. 6, having an intermediate body 56 secured in the cavity 52 by detent means, not shown. Projecting from one end of the body 56 are twin contact beams 58 having opposed contact surfaces 60 proximate to a mating face 62 of the housing 50. One end of the cavity 52 opens into the face 62 to receive a respective contact pin 26 of the connector 2. There projects from the other end of the body 56 of each terminal 54, a connector 64 which extends to a daughter printed circuit board 66 and is soldered to at least one printed conductor 68 thereon. The terminals 54 of each row of four terminals of the connector 32 are connected to conductors 68 of a common daughter board 66 as shown in FIG. 6.

In order to electrically connect each conductor 68 of the daughter board 66 to a respective contact pad 44 of the mother board 40 when the pin header connector 2 has been secured thereto, as described above, the connector 32 is mated with the connector 2 by inserting it between the shroud walls 30 of the connector 2. The face 62 is leading so that each contact pin 26 enters a respective cavity 52 of the connector 32, to be received between the contact surfaces 60 so that each contact surface 60 engage a respective contact surface C of the respective pin 26. The connector 32 may be any suitable connector that is commercially available such as the Four-Row Receptacle Assemblies manufactured by AMP Incorporated of Harrisburg, Pa., and distributed as Part Number series 532434-X.

By virtue of the twisting of each pin 26 through 45°, as described above, each contact surface 60 engages a flat contact surface C of a pin 26. Additionally, the longitudinal axes L of the contact springs 16 are angled by 45° with respect to the X and Y axes of the grid array of cavities 10 for maximum contact element density. The present structure permits the contact surfaces 60 to all extent parallel to one of the X and Y axes of the grid array of terminals 54 as is customary in the industry.

By virtue of the offsetting of the lugs 34 of the connector 2, a plurality of the connectors 2 may be secured to a common mother board 40 in modular relationship as will be apparent from FIG. 1. While the connector 2 is shown, in the present example, as having 24 contact elements 12, the present invention may be practiced with more or fewer such elements. Connectors having several hundred such contact elements are common in the industry.

What is claimed is:

1. A pin header electrical connector comprising;

an insulating housing having a flat interface surface and a mating face opposite thereto, said housing defining a multiplicity of contact element receiving, through cavities, each of which opens both into said interface surface and into said mating face; and a one-piece electrical contact element retained in each of said cavities and having an elongate contact spring proximate to said interface surface, said contact spring having a longitudinal axis extending substantially parallel to that surface, a contact nose on said contact spring projecting from said interface surface and a contact pin projecting from said mating face, said contact noses being arranged in a gird array having X and Y axes extending normally of each other and intersecting said interface surface, said longitudinal axes of said contact springs, all extending parallel to each other but being angled with respect to both of said X and Y axes, and each contact pin presenting opposed, flat contact surfaces which are parallel to one of said X and Y axes and extend at right angles to the other of those axes.

2. A connector as claimed in claim 1, wherein each contact element in each cavity has a retention part from which said contact pin extends and which has been force fitted into said cavity to retain said contact element therein and being coplanar with said contact spring of the contact element, said contact pin thereof having been twisted about its own axis with respect to said retention part and said contact spring to align said flat contact surfaces of said pin with one of said X and Y axes.

3. A connector as claimed in claim 1, wherein, said housing defines first and second portions of each cavity, said first portion containing the contact spring of the respective contact element, being proximate to said interface surface, and being elongate in a direction parallel thereto and in the direction of said longitudinal axis and said second portion being elongate in a direction at right angles to said interface surface and communicating at one end with said first portion, the other end of said second portion opening into said mating face.

4. A connector as claimed in claim 3, wherein said contact spring of said contact element is connected to the contact pin thereof by a retention portion of the contact element which has been force fitted into said second portion of the cavity, the contact spring and the retention portion being uniplanar and said contact surfaces of the contact pin being angled with respect to the plane of the contact spring and the retention portion.

5. A connector as claimed in claim 1, wherein each contact pin is rectilinear, having a longitudinal axis, said contact nose being bisected by the longitudinal axis of the contact pin.

6. A connector as claimed in claim 1, wherein each contact pin is rectilinear and is a square cross section, two first opposite sides of each contact pin being parallel to one of said X and Y axes and two second opposite sides of said pin being parallel to the other of said X and Y axes.

7. A connector as claimed in claim 1, wherein said longitudinal axes of all of said contact springs are angled by approximately 45° with respect to each of said X and Y axes.

8. A connector as claimed in claim 1, wherein said grid array is rectilinear.

9. A one-piece electrical contact element comprising a uniplanar, elongate contact spring, a retention part coplanar with said contact spring and having means for retaining the contact element in a cavity in an insulating housing, and a contact pin of rectangular cross section connected to one end of the retention part, the contact pin and the retention part having a common longitudinal axis, the contact spring comprising a spring arm connected to the other end of the retention part by means of a support arm extending at right angles to the contact pin, a contact nose on the contact spring projecting away from the contact pin in line with said common longitudinal axis, and the contact pin having opposite flat contact surfaces which are angularly displaced from the common plane of the contact spring and the retention part, about said common longitudinal axis.

10. A contact element as claimed in claim 9, wherein said contact surfaces are angularly displaced by approximately 45° with respect to said common plane.

11. A contact element as claimed in claim 9, wherein said pin is of square cross-section.

12. A contact element as claimed in claim 9, wherein said pin was twisted about said common axis relative to said retention portion.

13. A pin header electrical connector for interposition between a surface of a daughter circuit board having thereon a multiplicity of contact pads arranged in a grid array, and an electrical receptacle connector for mating with said pin header connector and being provided with twin beam receptacle terminals also arranged in said grid array, said pin header connector comprising;

an insulating housing having a flat interface surface having X and Y axes extending at right angles to each other in the plane thereof, and a mating face opposite to said interface surface and;

a multiplicity of parallel contact springs recessed beneath said interface surface, and being elongate in a direction parallel thereto, said contact springs being angled with respect to both of said X and Y axes for maximum contact density and having contact noses projecting from said interface surface, in said grid array, each for engagement with a respective one of said contact pads, a multiplicity of contact pins each electrically connected to a respective one of said contact springs, projecting from said mating face in said grid array, each for mating with a respective twin beam receptacle terminal of said receptacle connector, each contact pin having a pair of opposed, flat contact surfaces parallel to one of said X and Y axes, each for engagement by a respective beam contact of said respective twin beam receptacle terminal.

14. A connector as claimed in claim 13, in combination with said pin receptacle connector, wherein each twin beam receptacle terminal has a portion secured in electrically conductive relationship to a printed conductor at an edge of a daughter circuit board.

* * * * *